US005894778A

United States Patent [19]

Mori

[11] Patent Number: 5,894,778

[45] Date of Patent: Apr. 20, 1999

[54] PUNCHING APPARATUS

[75] Inventor: Chuzo Mori, Tokyo, Japan

[73] Assignee: Carl Manufacturing Co., Ltd., Tokyo, Japan

[21] Appl. No.: 08/956,295

[22] Filed: Oct. 23, 1997

[30] Foreign Application Priority Data

Oct. 25, 1996 [JP] Japan ..... 8-283789

[51] Int. Cl.[6] ..... B26D 5/08

[52] U.S. Cl. ..... 83/629; 83/560; 83/627; 83/684; 74/89.17

[58] Field of Search ..... 83/556, 559, 560, 83/563, 647, 685, 684, 686, 627, 628, 629; 74/89.15, 89.17, 424.6

[56] References Cited

U.S. PATENT DOCUMENTS

| | | | |
|---|---|---|---|
| 3,600,998 | 8/1971 | Palmer | 83/391 |
| 4,987,811 | 1/1991 | Ikarashi et al. | 83/372 |
| 5,588,344 | 12/1996 | Chun | 83/13 |
| 5,595,101 | 1/1997 | Yoshimatsu et al. | 83/40 |

FOREIGN PATENT DOCUMENTS

| | | |
|---|---|---|
| A 6-55499 | 3/1994 | Japan . |
| 8-206996 | 8/1996 | Japan . |

*Primary Examiner*—Peter Vo
*Assistant Examiner*—Kevin G. Vereene
*Attorney, Agent, or Firm*—Oliff & Berridge, PLC

[57] ABSTRACT

A punch, in which two operations, e.g., the movement of a head 1 along a rail 4 and the vertical movement of a punch 32 are carried out by the rotation of a slide transmission shaft 2 is provided, so that the bad influence of the inertia of the head 1 is suppressed, and the high speed operation is realized to thereby enhance the punching operation. The punch of the present invention comprises, a slide transmission shaft 2 to engage with a head 1, a driving member 28 having concentrically a helical cam 281 consisting of a helical portion and a vertical portion on its outer circumference and a punch driving gear, a rack 31 being parallel with the slide transmission shaft 2 and having teeth of the pitch identical with the pitch of the helical cam 281, while being engaged with the rack 31, and a punch driven gear 30 being rotated while being engaged perpendicularly with the punch driving gear 29 and having a pin 361 to be engaged with a rectangular hole 331 of the punch driving member 29. So that the head 1 is displaced along the rack 31 while the helical portion of the helical cam 281 is engaged with the rack 31. And an up-down movement of the tip end of the punch 10 is carried out with an area of punching process while the vertical portion of the helical cam 281 is engaged with the rack 31. Further, the head displacement and stoppage and the up-down movement of the punch are completely synchronized with the pitch of the holes to be punched.

3 Claims, 7 Drawing Sheets

PUNCHING APPARATUS

BACKGROUND OF THE INVENTION

The present invention relates to a punch or punching apparatus for punching documents when such documents or the like are to be filed.

A punching apparatus is disclosed as a conventional art in Japanese Patent Laid-Open Publication No. Hei 6-55499. In the punching apparatus disclosed in this publication, a punch portion is fitted in a punch-portion moving groove formed in a casing, and the moving punch portion is formed along the punch-portion moving groove. Then, the punch portion is fixed to an endless belt laid between a driving gear and a driven gear and is moved by the rotation of the driving gear rotated by a motor.

Also, in the drive mechanism of the punching apparatus installed in the punching portion, a crankshaft having a tip end at which a punch is connected by a pin is supported at its intermediate portion to be swingable, an oblong hole is formed in a rear end of the crankshaft connected to a crank, a gear is engaged with the crank, the gear is rotated by the motor (assuming that the motor is installed on the punch portion), the crankshaft is swung to thereby move the punch up and down, the punch is in coupling engagement with coupling hole formed on the casing side, and the punching in effected by a shearing force between the punch and the coupling hole.

A punch position setting guide formed in advance in conformity with the number and the pitch of holes is selected. The punch position setting guide is set under a guide detecting sensor provided in the punch portion to detect it. The motor for driving the gear to swing the above-described crankshaft and the motor of the driving gear for driving the above-described belt are controlled to thereby form the predetermined number of holes at a predetermined interval of the pitch.

In the above-described punching apparatus, since the punch portion is moved under the status where it is inserted into the punch-portion moving groove formed in the casing, when the holes are to be formed in the paper by the punch, there generates not a serious problem in the case where the number of pieces of paper is small. However, in the case where the number of pieces of paper is large, it is necessary to apply a relatively large force to the paper when punching them. Since this force is received by the punch portion, when punching the holes, the firm fixation is necessary to the punch portion to endure the force. Then, since the coupling hole is formed on the casing side, the pressing force of the punch may act on the punch portion as a reaction force. If the punch portion loses the fixing force, the punch could not be inserted into the coupling hole. As a result, it is practically impossible to insert the punch into the coupling hole. Further, undesirable friction is generated between the punch and the coupling hole, resulting in the reduction in cutting effect of the punch to shorten a life of the punch. Accordingly, only by the insertion of the punch portion into the punch-portion moving groove, there is no function to firmly fix the punch portion against the above-described reaction force. In order to firmly fix the punch portion, its structure is complicated and high-priced.

Also, since the punch is provided at the tip end of the swingable crankshaft, the force for pressing down the punch is not in the vertical direction. For this reason, in the case where a considerably large force is applied to the punch downwardly, an axis of the punch is displaced due to the relationship with the punching resistance, so that the undesirable friction is generated between the punch and the coupling hole. In the same manner as described above, the cutting effect of the punch is degraded to shorten a life of the punch.

Also, since the motor as the drive source for the crankshaft is mounted on the punch portion, a weight of the punch portion is increased, and the inertia when the punch portion is moved or stopped is increased. In particular, when the punch portion is driven by the belt, it is difficult to stop the moving punch portion having a large inertia in a suitable position. Also, since the inertia is large, it is impossible to move the punch portion at a high speed, resulting in poor efficiency of punching. Also, in the case where the motor is mounted on the moving punch portion, since the electric wirings are necessary between the motor and the power source which is located in the stationary portion, the wirings are dragged whenever the punch portion is moved. Therefore, there is a high possibility of damages such as a cut of the wirings and the like.

In order to solve the above-noted defects, the present applicant has proposed a punching apparatus in Japanese Patent Laid-open Publication No. Hei 8-206996. Its concept will now be described with reference to FIGS. 9 and 10. In FIG. 9, a slide transmission shaft 2 and a screw rod 3 are provided in parallel through a head 1. Also, a rectangular pillar is used as the slide transmission shaft 2. Reference numeral 4 denotes a rail for guiding the head 1 when it moves in directions indicated by arrows b. Four guide wheels 5 are engaged with the rail 4 so as to clamp the rail 4 in the vertical direction. Then, the four guide wheels 5 are rotatably supported to a support member 6 mounted on the head 1.

The head 1 is composed of a side wall 7 and a side wall 8. A guide member 9 is provided on a side surface of the side plate 7 so that the punch of a punch portion 10 provided under the guide member 9 is moved up and down along the guide member 9. Also, a punch-hole positioning portion 11 for determining the position of the punch while adjusting an insertion amount of the paper P is provided rotatably as indicated by arrows. The punch-hole positioning portion 11 is positioned by a punch-hole positioning regulator 12. Reference numeral 14 denotes an operation section in which gears for rotating the slide transmission shaft 2 and the screw rod 3 and the like are installed. Reference numeral 15 denotes a knob for operating a dog 16 for selecting the number of the holes and the pitch of the holes. Reference numeral 17 denotes limit switches for stopping the movement of the head 1, which are provided on both sides of the head 1 (not shown) and are provided movably to a support rod 18 so as to limit the movement range of the head 1 in response to a kind of paper P.

Namely, for example, when the head 1 is moved in the right direction while punching to complete the punching up to a predetermined position at the right end of the paper P, the head 1 is brought into contact with the limit switch 17 on the right side and stopped. Next, when the new paper P is set and the switch is turned on, the head 1 is moved in the opposite direction, i.e., on the left side while punching to complete the punching up to a predetermined position at the left final end of the paper P, the head 1 is brought into contact with the limit switch 17 on the left side and stopped. Thus, the punching is effected while the head 1 is being reciprocated so that the punching efficiency is enhanced and it is possible to set the punching positions of the final ends on the right and left sides by moving the limit switches 17 in relation with the size of the paper and the pitch between the holes.

As shown in FIG. 10, in the interior of the operating portion 14, a cam 19 is fixed to an end portion of the slide transmission shaft 2, and it is rotated by a motor (not shown) together with the cam 19. The limit switch 20 is turned on and off by the cam surface 191 of the cam 19, so that the slide transmission shaft 2 is rotated and stopped. Namely, a recessed cam surface 192 with which a movable piece 201 of the limit switch 20 does not slidingly contact is formed on the cam surface 191 of the cam 19. When the limit switch mounted on the head 1 is located at the recess portion of the dog 16 and is in the state "on", the motor for rotating the slide transmission shaft 2 is driven, and the movable piece 201 of the limit switch 20 is brought into sliding contact with the cam surface 191 to keep the rotation of the motor. When the slide transmission shaft 2 is rotated through one turn, the movable piece 201 of the limit switch 20 is located at the cam surface 192. The rotation of the motor is stopped, the rotation of the slide transmission shaft 2 is stopped.

Also, a driven gear 21 is fixed to an end portion of the screw rod 3. The screw rod 3 is rotated by the driving gear 22 fixed to the shaft of the motor. Namely, the movable piece of the limit switch mounted on the head 1 is brought into sliding contact with the recessed portion of the dog 16 so that the limit switch is turned on to rotate the motor for rotating the slide transmission shaft 2. The slide transmission shaft 2 is rotated through one turn so that the movable piece 201 of the limit switch 20 is located on the cam surface 192 to turn off the limit switch 20. As a result, the motor for driving drive gear 22 is driven to move the head 1. Also, the motor may be rotated in the forward direction and the reverse direction. Also, in FIG. 10, when the slide transmission shaft 2 is rotated and a punching-pin driving gear 25 in rotated, a pin driven gear 24 engaged with the driving gear 25 is rotated. A driving member 23 mounted eccentrically on the pin driven gear 24 is engaged with an oblong hole 27 formed in a slider 26. The slider 26 is moved up and down. The punching pin 32 mounted on the slider 26 is moved up and down in the vertical direction.

In the punching apparatus shown in FIGS. 9 and 10, the movement of the head 1 in the directions indicated by arrows b (in the boring pitch directions) is carried out by the screw shaft, and the up-and-down movement of the punching pin is carried out by the slide transmission shaft. The timing between the both is taken by the cam and the limit switches. Accordingly, the structures become complicated. Also, since the intermittent movement of the head is carried out by the rotation and the rotation stop of the motor, in the high speed intermittent movement of the head, the inertia also works due to the weight of the head. There is a limit to the high speed intermittent movement of the head.

SUMMARY OF THE INVENTION

An object of the present invention is to provide a punching apparatus in which, while maintaining such functions of the punching apparatus shown in FIGS. 9 and 10, that a life of a punch is elongated, the installation of the punching on the head is dispensed with to reduce the inertia of the head, and the inconvenience of the wirings is obviated, a structure is simplified by carrying out the two operations, i.e., the movement of the head and the vertical movement of the punching pin, due to the rotation of the slide transmission shaft, the bad influence of the inertia of the head is suppressed by making it possible to intermittently move the head by rotating continuously the slide transmission shaft, and furthermore, the punching efficiency is enhanced by increasing the speed of the intermittent movement of the head.

A means which may be understood from the description of the claim 1 of the present invention for solving the above-described is mentioned as follows.

A punch of the present invention is characterized in that the punch comprises, a slide transmission shaft to engage with a head, a driving member having a concentrically helical cam consisting of a helical portion and a vertical portion on its outer circumference and a punch driving gear, a rack being parallel with the slide transmission shaft and having teeth of the pitch identical with the pitch of the helical cam, while being engaged with the rack, and a punch driven gear being rotated while being engaged perpendicularly with the punch driving gear and having a pin to be engaged with a rectangular hole of a punch driving member, wherein the head is displaced along the rack while the helical portion of the helical cam being engaged with the rack, and an up-down movement of the tip end of the punch is carried out within an area of punching process while the vertical portion of the helical cam being engaged with the rack, and the head displacement and stoppage, and the up-down movement of the punch are completely synchronized with the pitch of the holes to be punched.

Next, how to solve the problems by the invention which may be understood from the claim 1 of the present invention will now be explained. Since the slide transmission shaft is provided so as to come through the head, and the driving member in which the spiral cam is formed on its outer circumference and the punch driving gear are engaged with the slide transmission shaft and provided on the head, it is possible to drive the punch driving gear and the driving member merely by the rotation of the single slide transmission shaft.

Then, the rack that engages with the spiral cam of the driving member is provided in parallel with the slide transmission shaft, the punch driven gear for moving up and down the punch in engagement with the punch driving gear, and the driving member and the punch driving gear are rotated by the rotation of the slide transmission shaft. As a result, the punching driven gear is rotated so that the punch provided in the head is moved up and down, and the head is intermittently moved by the spiral cam. Accordingly, it is possible to move the head intermittently and the punching pin up and down by the continuous rotation of the mere single slide transmission shaft.

An embodiment which may be understood from the claim 1 of the present invention as shown in FIG. 1 is directed to a punching apparatus in which a head 1 is intermittently moved in conformity with a pitch of holes by a moving means and the holes are formed in paper by a punch 32 provided on the head 1, characterized in that a slide transmission shaft 2 is provided so as to penetrate said head 1, and as shown in FIG. 2, a member 28 in which a spiral cam 281 is formed on its outer circumferential surface and a punch driving gear 29 are in engagement with said slide transmission shaft 2 are provided in said head 1 as shown in FIG. 5.

Then, as shown in FIGS. 1 and 2, a rack 31 that engages with the spiral cam 291 of said member 28 is provided in parallel with said slide transmission shaft 2, a punch driven gear 30 for moving the punch 32 up and down and engaging with said punch driving gear 29 is provided, and the driving member 28 and the punch driven gear 30 are rotated by the rotation of said slide trasmission shaft 2, whereby the punch 32 provided in the head 1 is moved up and down by the rotation of the punching driven gear 30, and the head 1 is intermittently moved by the spiral cam 281.

DESCRIPTION OF THE PREFERRED EMBODIMENTS

Figure 1:
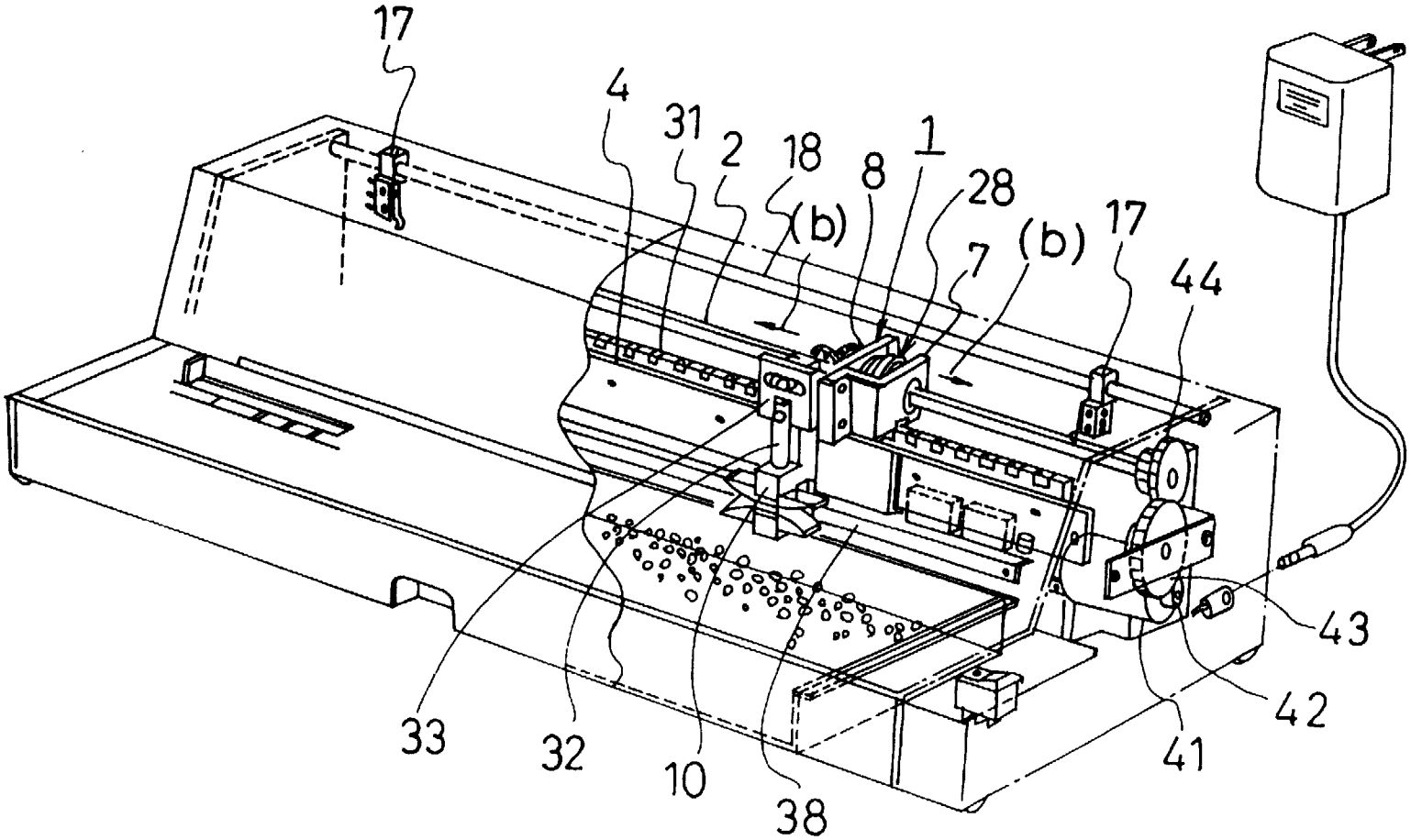
FIG. 1 is a perspective view showing an overall appearance of a punching apparatus in accordance with the embodiment.

One embodiment of the present invention will now be described. FIG. 1 is a perspective view showing an overall appearance of the embodiment. A slide transmission shaft 2 is provided through a head 1. In the embodiment, a sectional rectangular pillar is used as the slide transmission shaft 2 so that a less costly slide transmission shaft that does not need the spline machining is provided. However, it is a matter of course to be able to use a cylindrical rod with the spline machining. Also, a rack 31 is provided below the slide transmission shaft 2 in parallel to the slide transmission shaft 2. Further, a rail 4 is provided for guiding the head 1 when the head 1 is moved in the directions indicated by arrows b in parallel to the side surface of the rack 31.

The head 1 is composed of side plates 7 and 8. A punch driving member 33 is provided in the head 1. A punch 32 of a punch portion 10 provided below the punch driving member 33 is moved up and down by a sliding member. Reference numeral 17 denotes limit switches for stopping the movement of the head 1, which are provided on both sides of the head 1 and are provided movably to a support rod 18 so as to limit the movement range of the head 1 in response to a kind of paper P.

Namely, for example, when the head 1 is moved in the right direction while punching up to a predetermined position at the right final end of the paper P, the head 1 is brought into contact with the limit switch 17 on the right side and stopped. Next, when the new paper P is set and the switch is turned on, the head 1 is moved in the opposite direction, i.e., on the left side, while punching up to a predetermined position at the left final end of the paper P, the head 1 is brought into contact with the limit switch 17 on the left side and stopped. Thus, the punching is effected while the head 1 is being reciprocated so that the boring efficiency is enhanced and it is possible to set the punching positions of the final ends on the right and left sides by moving the limit switches 17 in relation with the size of the paper and the pitch between the holes.

Figure 2:
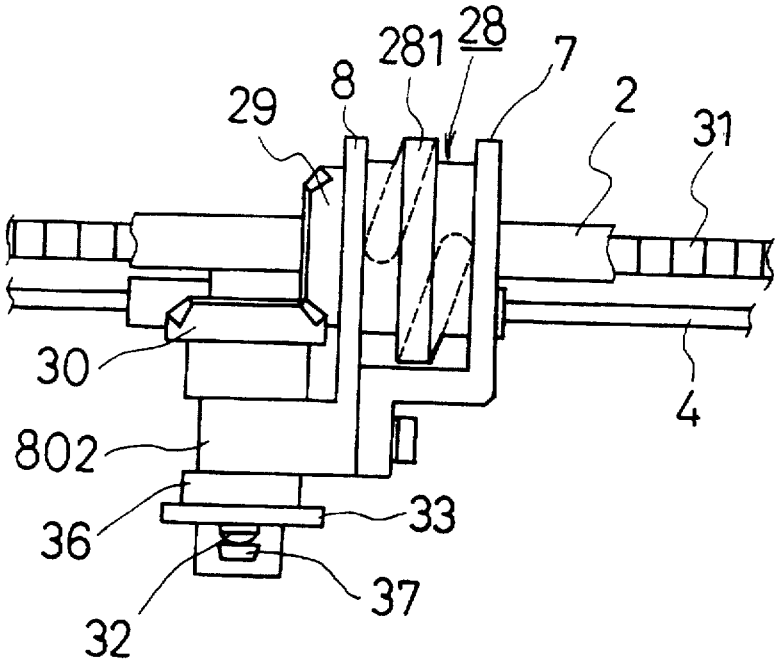
FIG. 2 is a plan view showing a head portion shown in FIG. 1.
Figure 5:
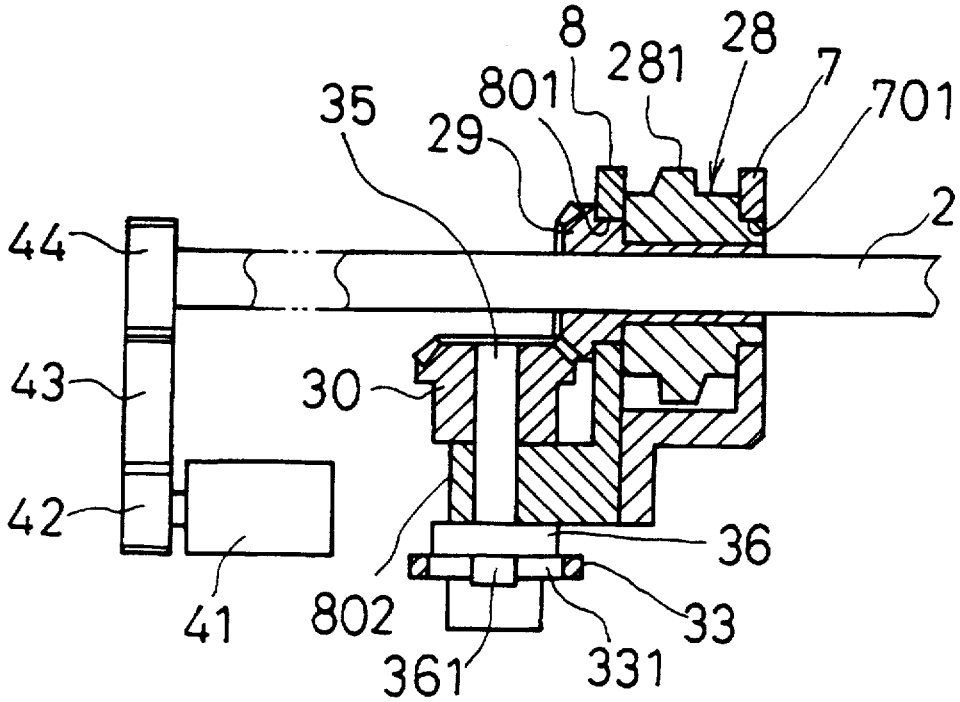
FIG. 5 is a cross-sectional view taken along the line A—A of FIG. 4.

The detail of each portion shown in FIG. 1 will now be explained in order. FIG. 2 is a plan view of the head 1 portion shown in FIG. 1. A driving member 28 in which a spiral cam 281 is formed is provided between the side plates 7 and 8. More specifically with respect to this, referring to FIG. 5, bearing holes 701 and 801 are formed in the side plates 7 and 8, respectively, a punch driving gear 29 is supported to the bearing hole 801, the member 28 is fitted with the shaft portion of the punch driving gear 29, and the member 28 is pivotally supported to the bearing hole 701. With such a structure, under the condition that the punch driving gear 29 and the driving member 28 are kept in a unit, these components are supported rotatably to the side plates 7 and 8. Then, the slide transmission shaft 2 made of a rectangular rod is inserted into a rectangular hole formed in the punch driving gear 29. In FIG. 5, a driven gear 44 is fixed to an end portion of the slide transmission gear 2 so that the slide transmission shaft 2 may be rotated by the driving gear 42 fixed to a shaft of a motor 41 through an intermediate gear 43. Then, the driving member 28 is rotated together with the punch driving gear 29 by the rotation of the slide transmission shaft 2.

Figure 3:
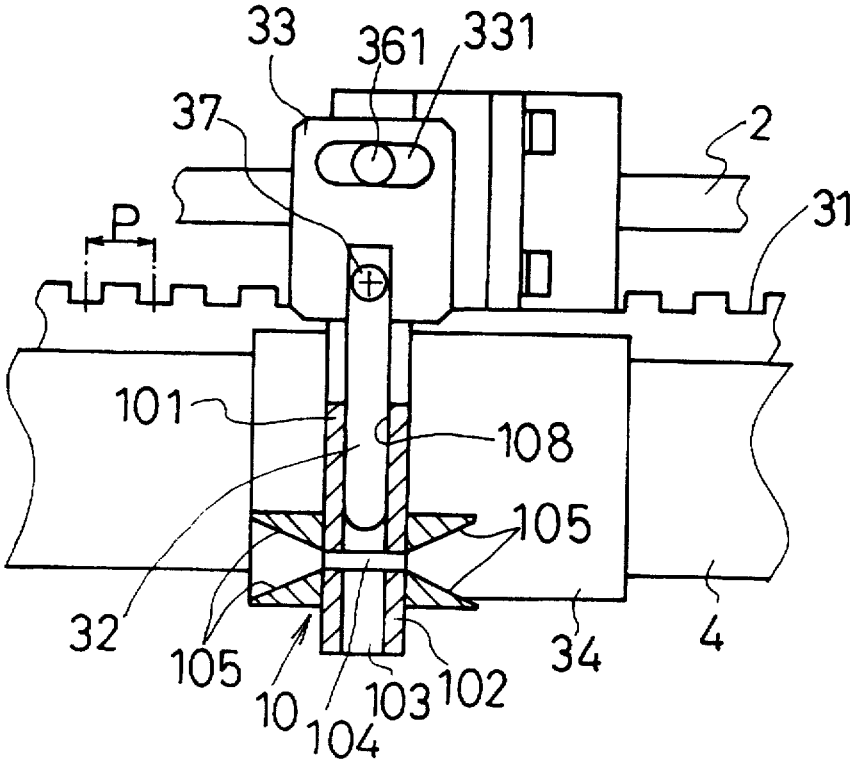
FIG. 3 is a frontal view showing the structure shown in FIG. 2 with a partial longitudinal cross-section.
Figure 4:
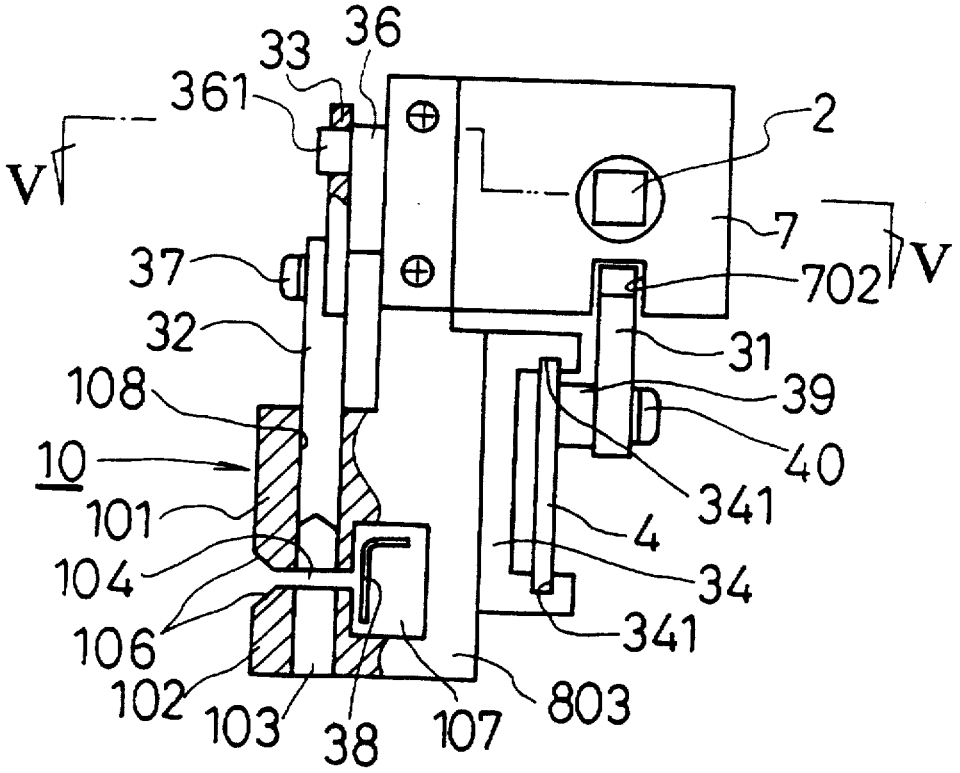
FIG. 4 is a side elevational view showing the structure shown in FIG. 2 with a partial longitudinal cross-section.

As shown in FIGS. 2 and 5, the side plate 8 has an L-shape in plan view and is provided with a base portion 802. A shaft 35 is pivotally supported to the proximal end 802. A punch driven gear 30 that engages with the punch driving gear 29 is fixed to one end of the shaft 35, and a cam plate 36 is fixed to the other end. Also, a cam follower 361 is fixed in the cam plate 36 at an eccentric position relative to an axis of the cam plate 36. As shown in FIGS. 3 and 5, the cam follower 361 is in coupling engagement with an oblong hole 331 formed in the punch driving member 33. Then, as shown in FIGS. 3 and 4, the punch 32 is fixed to the punch driving member 33 by a screw 37. Thus, when the slide transmission shaft 2 is rotated, the driving member 28 and the punch driving gear 29 are rotated, the punch driven gear 30 that engages with the punch driving gear 29 is rotated to rotate the cam plate 36. As a result, the punch driving member 33 is moved up and down corresponding to the eccentric amount of the cam follower 361 and the punch 32 is moved up and down.

In FIGS. 3 and 4, a punch portion 10 is formed at a lower end 803 formed to be extended below the proximal end 802 of the side plate 8. A paper insertion gap 104 is provided with the punch portion 10, and an upper punch guide portion 101 and a lower punch guide portion 102 are provided at an upper and a lower portions of the paper insertion gap 104. A punch hole 103 and a guide hole 108 into which the punch 32 is inserted are formed through the upper and lower punch guide portions 101 and 102. Thus, in the case where the paper is inserted into the paper insertion gap 104, and the punch 32 is lowered to form a hole, the punching force of the punch 32 works on the lower punch guide portion 102 so as to expand the paper insertion gap 104. However, a mechanical strength of the lower punch guide portion 102 is made sufficient to thereby eliminate any deformation of the lower punch guide portion 102 so that it is possible to eliminate any undesirable friction between the punch hole 103 and the punch 32, resulting in elongation of the life of the punch 32.

In FIG. 4, a hollow portion 107 for insertion of the paper-positioning member 38 (see FIG. 1) is formed at a rear portion of the paper insertion gap 104 so that the head 1 shown in FIG. 1 may be moved in the directions indicated by the arrows b. At the same time, the edge of the paper inserted through the paper insertion gap 104 is brought into contact with the paper-positioning member 38 so that the position of the punch 32 is determined from the edge of the paper so that the hole may be formed at a predetermined position. Incidentally, in FIG. 3, reference numeral 105 denotes guide surfaces for guiding the paper when the head 1 is moved in the directions indicated by the arrows b. Also, in FIG. 4, reference numeral 106 denotes paper-insertion guide surfaces for facilitating the insertion of the paper into the paper insertion gap 104.

In FIG. 4, the support member 34 is fixed to a back surface of the lower end 803 of the side plate 8, and guide grooves 341 fitted along the rail 4 are formed at an upper and a lower portions of the support member 34. Thus, under the status where the overall head 1 is supported to the rail 4, the head 1 may be moved in the directions indicated by the arrows b in FIG. 1. A stepped fastening pin 39 is implanted in the rail 4, and the rack 31 is fixed to the stepped fastening pin 39 by a screw 40. Also, the rack 31 is positioned in a cutaway portion 702 of the side plate 7 and is engaged with a spiral cam 281 formed in the driving member 28 shown in FIG. 2. The pitch P of the rack 31 shown in FIG. 3 is equal to the pitch of holes to be formed in the paper.

Figure 6:
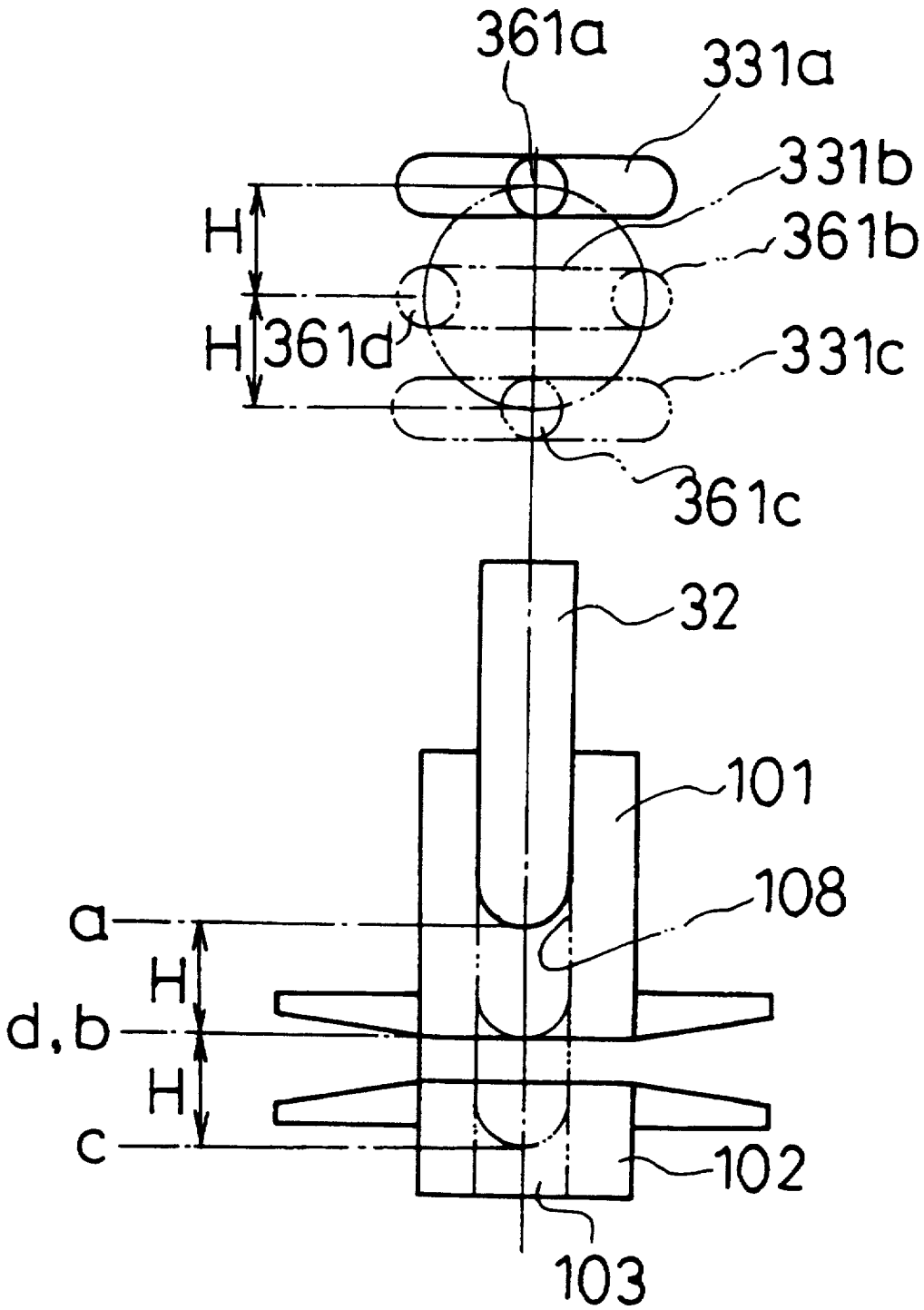
FIG. 6 is a schematic view showing an operation relationship between a cam follower and the punch shown in FIG. 3.

FIG. 6 is a view showing a relationship between the movement of the cam follower 361 and the vertical movement of the punch 32. The punch 32 is moved up and down by one stroke during one turn of the cam follower 361. Namely, when the cam follower is positioned at a position 361*a*, the oblong hole is located at a position 331*a* and the punch 32 is located at a position a. When the cam plate 36 is rotated so that the cam follower is moved at a position 361*b* and the punch driving member 33 is pushed down and the oblong hole is moved at a position 331*b*, the punch 32 is located at a position b. Furthermore, when the cam plate 36 is rotated so that the cam follower is moved at a position 361*c* and the punch driving member 33 is pushed down so that the oblong hole is moved at a position 331*c*, the punch 32 is located at a position c. Subsequently, the cam plate 36 is rotated so that the cam follower is moved at position 361*d*. When the punch driving member 33 is lifted so that the oblong hole is moved at a position 331*d*, the punch 32 is raised at a position d. When the cam plate 36 is rotated through one turn so that the cam follower is moved at a position 361*a*. When the punch driving member 33 is raised and the oblong hole is located at the original position 331*a*, the punch 32 is raised up to the position a.

In the swivel motion of the cam follower 361, during the rotation from 361*b* (90° swivel motion) to 361*d* (270° swivel motion), the punch 32 is lowered from the position b to the position c, and it takes the lifting motion from the position c to the position d to thereby perform the punching operation. During this period, the punch 32 is kept under the condition that it projects from the guide hole 108 so that the head 1 is prevented from moving.

Also, in the swivel motion of the cam follower 361, during the rotation from 361*d* (270° swivel motion) to 361*a* (360° swivel motion), the punch 32 is raised from the position d to the position a. Furthermore, by the 90° rotation from 361*a* to 361*b*, the punch 32 takes the lowering motion from the position a to the position b. During this period, the punch 32 is kept under the condition that it is retracted in the guide hole 108 and under the condition that the head 1 may be moved. Also, as is apparent from FIG. 6, when the punch 32 is located at the positions d or b, the blade tip of the punch 32 is located at substantially the same position as that of the opening end of the guide hole 108.

Figure 7:
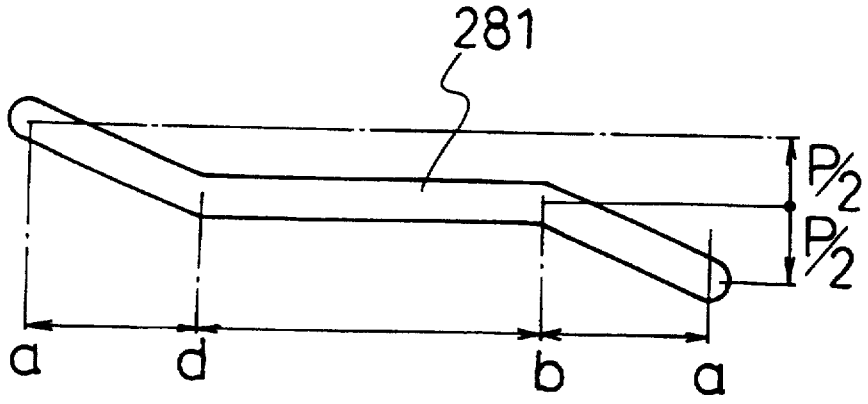
FIG. 7 is a developed view showing the spiral cam shown in FIG. 2.

Next, FIG. 7 is a developed view of the herical cam 281 formed on the outer circumference of the member 28 shown in FIG. 2. The herical cam 281 is formed on the circumference of the member 28 in the form of a herical shape of half the hole pitch P to be punched between a-b and d-a (hereinafter referred to as a head moving cam). The herical cam 281 is formed on the outer circumferential surface of the member 28 under the condition that the pitch is zero between b and d (see FIG. 2). Then, the movements a-b and d-a correspond, respectively, to ranges of rotational angle 90 of the cam plate 36. Between both a-b and d-a along the herical cam 281, the pitch of the holes to be formed in the paper is kept at one pitch P. Also, the herical cam 281 is formed in the rotational range of 180 of the cam plate 36.

Then, while the member 28 is being rotated through b-c-d (b-d of herical cam 281 in FIG. 7), the punch 32 is moved through b-c-d in FIG. 6 to bore the hole. Subsequently, while the driving member 28 is being rotated through d-a-a-b (d-a-a-b of herical cam 281 in FIG. 7), the punch 32 is moved through d-a-a-b in FIG. 6 to be retracted in the guide hole 108 so that the head 1 is moved through one pitch P.

The operation according to the above-described structure of the embodiment will now be explained. As shown in FIG. 5, the slide transmission shaft 2 is provided to penetrate the head 1, and the driving member 28 having the outer circumferential surface on which the herical cam 281 is formed and the punch driving gear 29 engaged with the slide transmission shaft 2 are provided on the head 1. Accordingly, when the switch for the motor 41 is turned on and the slide transmission shaft 2 is rotated, it is possible to rotate the driving member 28 and the punch driving gear 29.

In case of the embodiment, as shown in FIG. 5, the bearing holes 701 and 801 are formed in the side plates 7 and 8, the punch driving gear 29 is pivotally supported to the bearing hole 801, the driving member 28 is engaged with the shaft portion of the punch driving gear 29 to make it in a unit, the driving member 28 is pivotally supported to the bearing hole 701, and the slide transmission shaft 2 that is formed of the rectangular rod is inserted into the rectangular hole maded in the punch driving gear 29. Accordingly, the structure is simplified to thereby reduce the weight of the head 1, and the inertia when the head 1 is moved in the directions indicated by the arrows b in FIG. 1, so that it is possible to realize the high speed movement.

Then, the rack 31 with which theherical cam 281 of the driving member 28 engages is provided in parallel with the slide transmission shaft 2, and at the same time, the punch driven gear 30 engaged with the punch driving gear 29 is provided for moving up and down the punch 32, the driving member 28 and the punch driving gear 29 are rotated by the rotation of the slide transmission shaft 2, and the punch 32 formed in the head 1 may be moved up and down by the rotation of the punch driven gear 30, so that the member 28, the punch driving gear 29, the punch driven gear 30 and the cam plate 36 are rotated by the single slide transmission shaft 2, the punch drive member 33 may be moved up and down in correspondence with the eccentric amount of the cam follower 361 and the punch 32 may be moved up and down.

Then, since the rack 31 with which the herical cam 28 of the driving member 28 is engaged is provided in parallel with the slide transmission shaft 2 and the head 1 is intermittently moved by the herical cam 281, the head 1 may be intermittently moved by the continuous rotation of the mere single slide transmission shaft 2, and at the same time, the punch 32 may be moved up and down.

Figure 8:
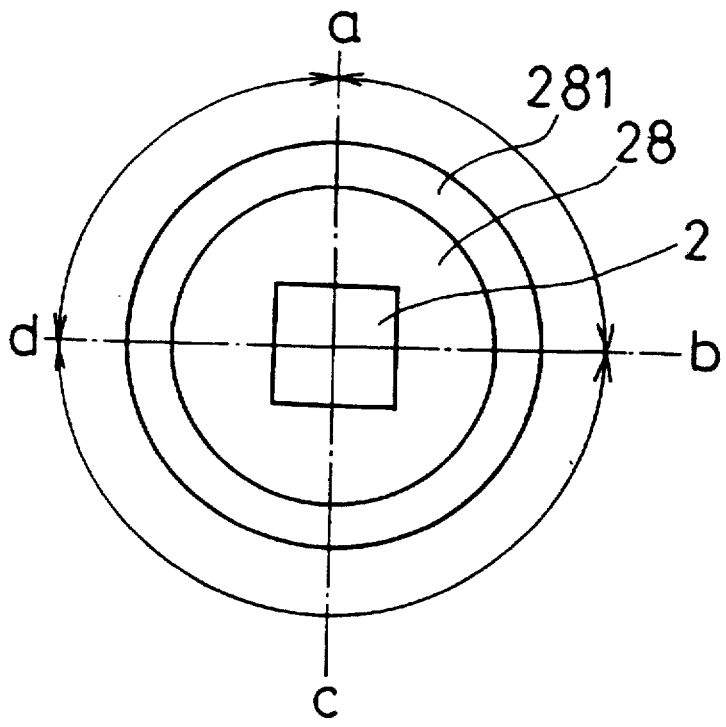
FIG. 8 is an illustration of the relationship between the rotation of the driving member shown in FIG. 1 and the spiral cam shown in FIG. 7.
Figure 9:
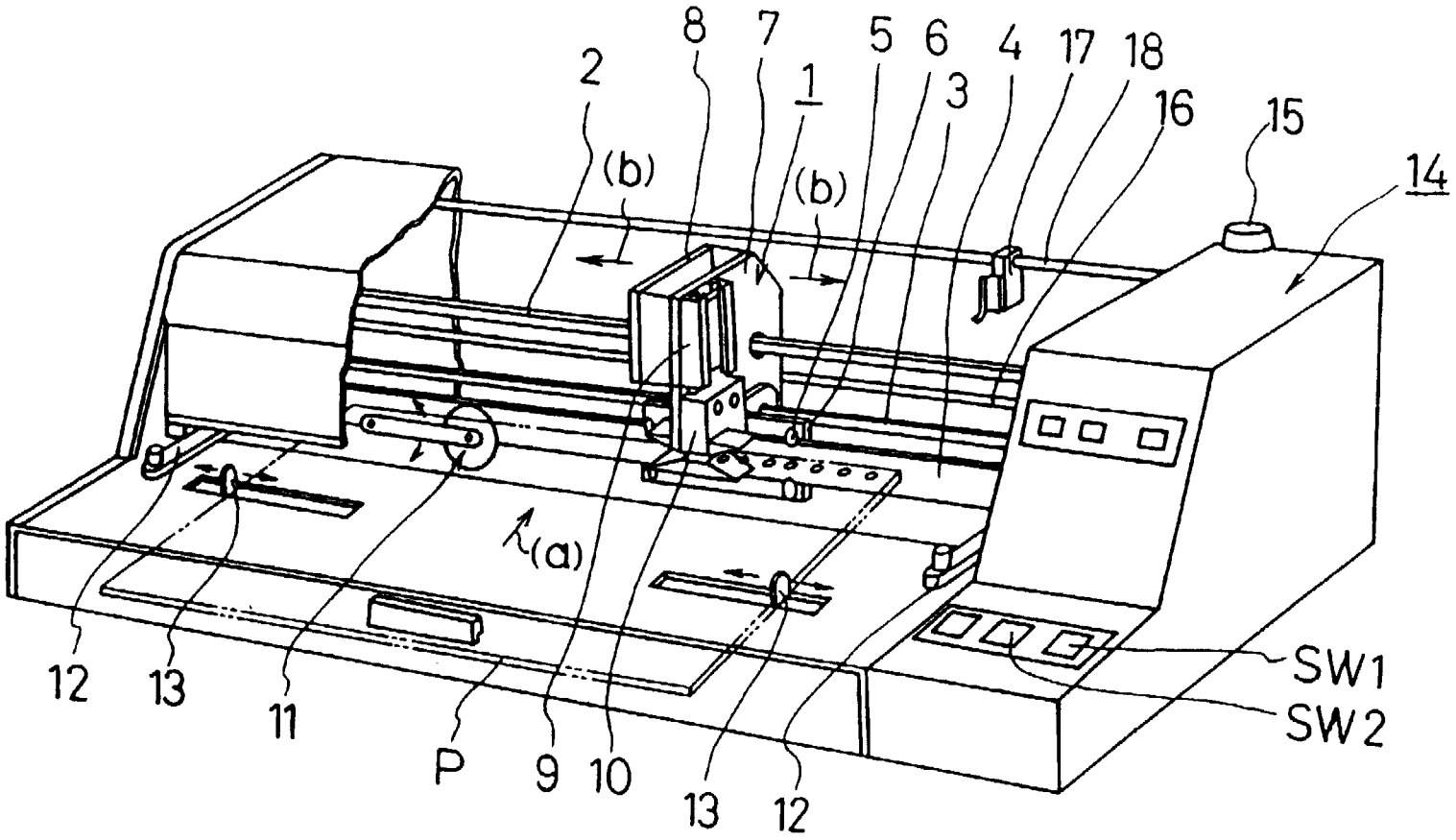
FIG. 9 PRIOR ART
FIG. 9 is a perspective view showing an overall conventional punching apparatus.
Figure 10:
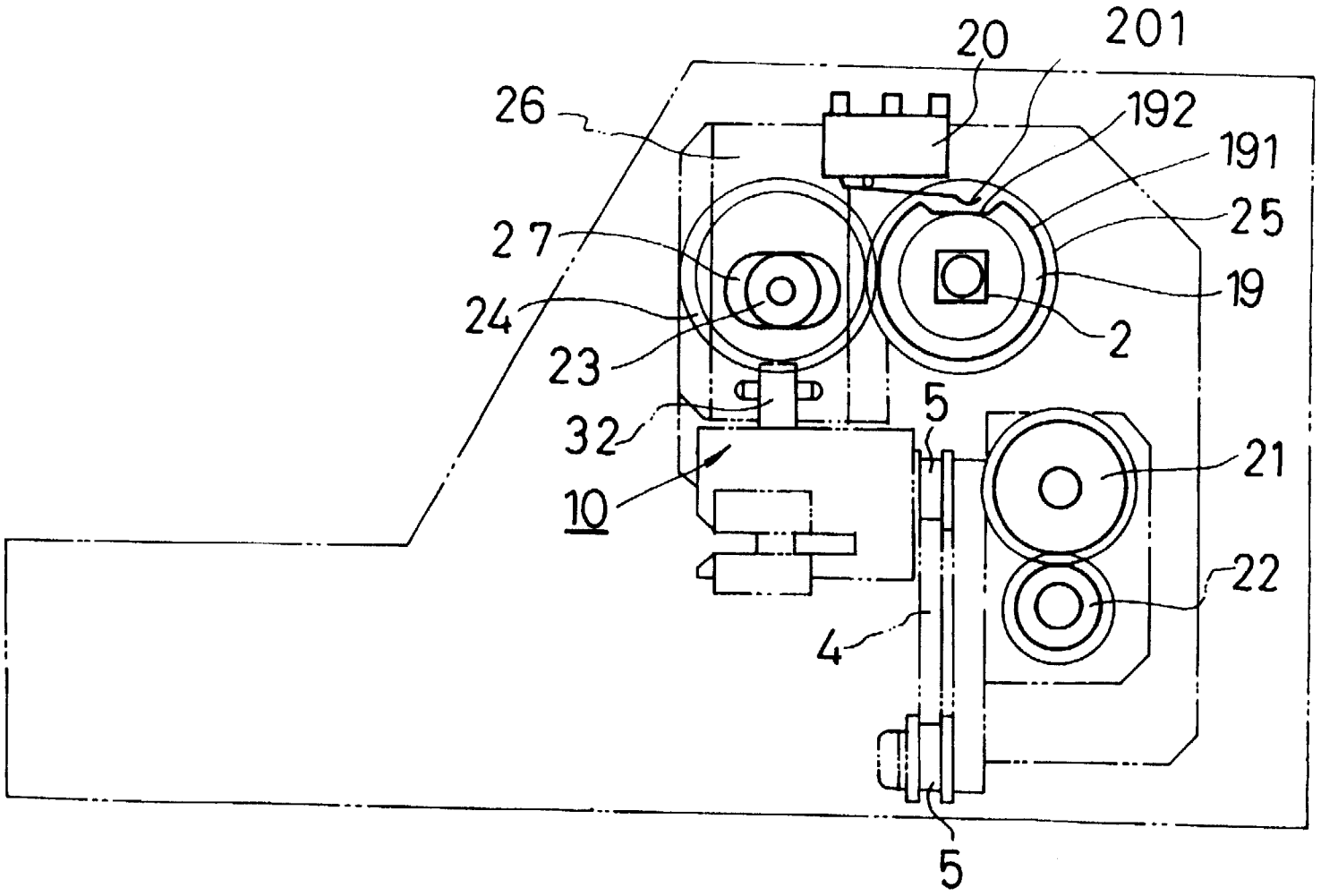
FIG. 10 is a side elevational view showing the interior of the operating portion shown in FIG. 9.

Namely, in the embodiment as shown in FIG. 7, between a-b and d-a, the herical cam 281 is formed on the outer circumferential surface in the form of the herical shape of half a pitch of the hole pitch P to be formed, and between b and d, the herical cam 281 is formed on the outer circumferential surface of the driving member 28 under the condition that the pitch is zero between b and d, and the herical cam 281 is engaged with the rack 31 of the pitch P as shown in FIG. 3, the punch 32 shown in FIG. 6 is moved by the continuous rotation of the mere single slide transmission shaft 2 while the member 28 is being rotated in d-a-a-b (180°) shown in FIG. 8. The punch 32 is retracted into the guide hole 108, the head 1 is moved by the pitch P that is equal to the hole pitch. During the period when the member 28 is rotated through b-c-d (180°) (during the period when the head stopping cam and the rack 31 are engaged with each other), the head 1 is stopped. As shown in FIG. 6, the punch 32 is moved up and down through b-c-d to form the hole.

According to the invention which may be understood from the detailed explanation of the invention on the basis of the claim 1 of the present invention as described in detail, the slide transmission shaft is provided to penetrate the head, the member in which the herical cam is formed on the outer circumferential surface thereof and the punch driving gear are engaged with the slide transmission shaft, the punch driving gear and the driving member are rotated by the rotation of the mere single slide transmission shaft, the rack with which the herical cam of the member is engaged is provided in parallel with the slide transmission shaft, the punch driven gear that is engaged with the punch driving gear for moving the punch up and down is provided, the punch provided in the head for rotating the punch driven gear is moved up and down, the head is intermittently moved by the herical cam, the head is intermittently moved by the continuous rotation of the mere single slide transmission shaft, and the boring pin may be moved up and down. Accordingly, the two operations, i.e., the movement of the head and the vertical movement of the boring pin, are carried out by the single slide transmission shaft to thereby simplify the structure. In addition, the slide transmission shaft is continuously rotated by the engagement with the rack to thereby intermittently move the head, to thereby reduce the bad influence of the inertia of the head. Furthermore, it is possible to increase the intermittent movement of the head to enhance the efficiency of the boring operation.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A punching apparatus comprising:

a rotatable slide transmission shaft;

a head including a driving member, a punch driven gear and a punch driving member;

said head being in sliding contact with said slide transmission shaft so as to move in a direction parallel to an axis of said slide transmission shaft;

said driving member of said head engaging rotatably with said slide transmission shaft;

said driving member having concentrically a cam consisting of a helical portion and a vertical portion on an outer cylindrical surface thereof, and a punch driving gear, said punch driving gear said slide transmission shaft rotating on an axis parallel to an axis thereof;

a rack being parallel with said slide transmission shaft and having teeth of a pitch corresponding to a pitch of the helical portion of said cam, said cam engaging with teeth of said rack; and said punch driven gear being rotated by said punch driving gear on an axis perpendicular to said axis thereof, and having a pin that engages with an elongated hole of said punch driving member, such that rotating said punch driven gear moves said punch driving member down and then back up in a punching direction perpendicular to said axis of said punch driven gear;

wherein said head, intermittently, moves along the rack while the helical portion of said cam is engaged with the rack and stops and remains in a position along the rack while the vertical portion of said cam is engaged with the rack; and wherein said punch driving member moves a tip end of a punch down and then back up in said punching direction while the vertical portion of said cam is engaged with the rack.

2. An apparatus according to claim 1, wherein said head moves a predetermined distance between successive stops along said rack corresponding to a spacing between successive holes to be punched.

3. An apparatus according to claim 2, wherein, while the vertical portion of said cam is engaged with the rack and the head remains in a stopped position along the rack, said tip end of said punch moves down and then back up in said punching direction a predetermined distance corresponding to a maximum thickness of a material to be punched.

* * * * *